United States Patent [19]

Gale

[11] 4,286,924

[45] Sep. 1, 1981

[54] ROTOR BLADE OR STATOR VANE FOR A GAS TURBINE ENGINE

[75] Inventor: Anthony G. Gale, Wollaton, England

[73] Assignee: Rolls-Royce Limited, London, England

[21] Appl. No.: 968,928

[22] Filed: Dec. 13, 1978

[30] Foreign Application Priority Data

Jan. 14, 1978 [GB] United Kingdom ..... 01552/78

[51] Int. Cl.[3] ..... F01D 5/18

[52] U.S. Cl. ..... 416/97 R; 415/115

[58] Field of Search ..... 416/97 R, 97 A, 223, 416/222, 96 R, 96 A; 415/115

[56] References Cited

U.S. PATENT DOCUMENTS

| | | | |
|---|---|---|---|
| 2,848,192 | 8/1958 | Hayes | 416/233 |
| 3,111,302 | 11/1963 | Bowmer | 416/233 |
| 3,623,825 | 11/1971 | Schneider | 416/97 |
| 3,627,443 | 12/1971 | Pirzek | 416/233 |
| 3,650,635 | 3/1972 | Wachtell et al. | 416/97 |
| 3,799,696 | 3/1974 | Redman | 415/115 |
| 3,809,494 | 5/1974 | Redman | 416/97 |
| 3,825,984 | 7/1974 | Linko et al. | 416/97 |
| 3,844,678 | 10/1974 | Sterman et al. | 416/97 |
| 3,921,271 | 11/1975 | Dennis et al. | 29/156.8 H |
| 3,930,748 | 1/1976 | Redman et al. | 415/115 |
| 3,934,322 | 1/1976 | Hauser et al. | 29/156.8 H |
| 4,026,659 | 5/1977 | Freeman, Jr. | 416/97 |

*Primary Examiner*—Everette A. Powell, Jr.

*Attorney, Agent, or Firm*—Cushman, Darby & Cushman

[57] ABSTRACT

An aerofoil blade or vane for a gas turbine engine comprises an aerofoil which includes one only of the two flanks of the trailing edge of the aerofoil and which is an integrally cast structure. The other flank of the trailing edge is formed as a separate piece which is metallurgically bonded to the remainder of the aerofoil through a joint face. The aerofoil is adapted for the supply of cooling fluid to its interior and the joint face is cut away to form an exit passage or passages for cooling fluid which leaves the interior of the aerofoil.

5 Claims, 7 Drawing Figures

ROTOR BLADE OR STATOR VANE FOR A GAS TURBINE ENGINE

This invention relates to an aerofoil blade or vane, such as a rotor blade or stator vane for a gas turbine engine.

It is common practice for such blades or vanes to be cooled, normally by the flow of cooling air through their hollow interiors. It is often useful to discharge this cooling air through slots, holes or other apertures in the trailing edge of the aerofoil of the blade or vane.

For aerodynamic reasons it is preferable if the trailing edge of the aerofoil is made as thin as possible and it has therefore been very difficult to make these apertures, since they have to be of very small size and very accurately located.

The present invention provides a blade or vane in which the apertures may be formed in a convenient and potentially accurate manner.

According to the present invention an aerofoil vane for a gas turbine engine comprises an aerofoil, including one flank of the trailing edge thereof, which is an integral cast structure, the other flank of the trailing edge comprising a separately formed piece which is metallurgically attached to the remainder of the aerofoil, the joint face between the integral flank and the other flank of the trailing edge being cut-away to form exit channels for cooling air which leaves the interior of the aerofoil.

Preferably the aerofoil is hollow, and the exit channels communicate with the hollow interior of the blade and its exterior surface in the region of the trailing edge.

Said exit channels may be formed by channels in one of the flanks co-operating with the flat surface of the other flank, or there may be co-operating sets of channels.

Alternatively one flank may be provided with projections or pedestals which support the other flank so as to produce a trailing edge slot.

The separately formed pieces may be extended below the blade platform to provide additional mechanical support for the piece.

The invention also includes a method of making a blade or vane in which the aerofoil including one flank of the trailing edge is cast as a unitary whole, the other flank of the trailing edge being made separately and metallurgically attached to the remainder of the aerofoil.

The aerofoil may require subsequent machining to remove the witness of the metallurgical attachment, and it may be desirable to machine the cast flank of the aerofoil to produce cooling air channels.

Figure 1:
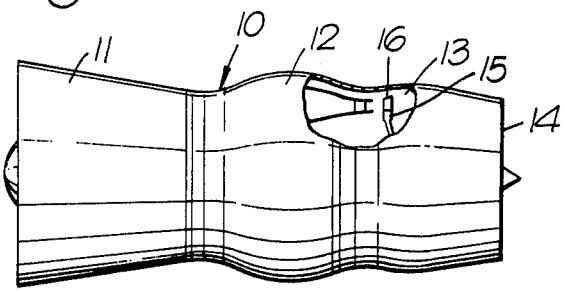
Figure 2:
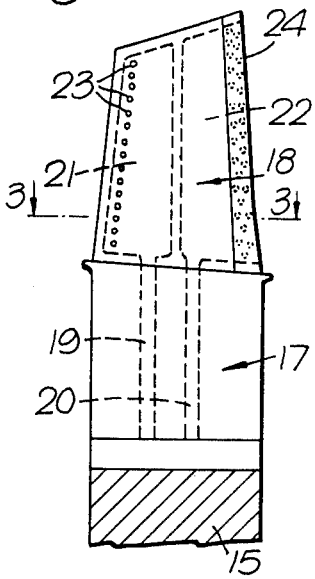
Figure 3:
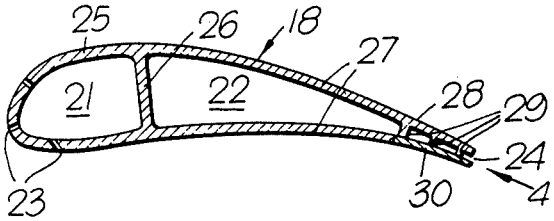
Figure 4:
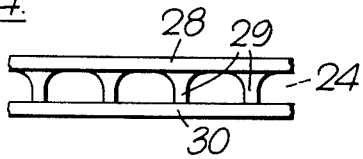
Figure 5:
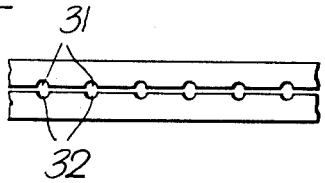
Figure 6:
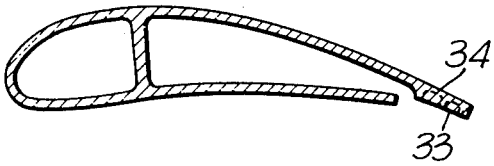
Figure 7:
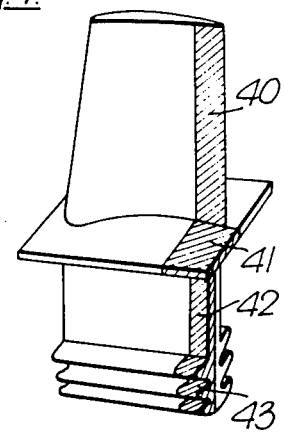

The invention will now be particularly described merely by way of example, with reference to the accompanying drawings in which:

FIG. 1 is a partly broken away view of a gas turbine engine having turbine rotor blades in accordance with the invention, FIG. 2 is an enlarged section of the turbine rotor of FIG. 1, FIG. 3 is a section on the line 3—3 of FIG. 2, FIG. 4 is a view on the arrow 4 of FIG. 3, FIG. 5 is a view similar to that of FIG. 4 but of another embodiment, FIG. 6 is a view similar to FIG. 3 showing how the cast aerofoil may require machining, and FIG. 7 is a perspective view of a further embodiment of a blade according to the invention.

In FIG. 1 there is shown a gas turbine engine comprising a casing 10 within which are mounted a compressor 11, combustion section 12 and turbine 13 and which forms a final nozzle 14. The casing is broken away to expose to view the downstream end of the combustion chamber, and the rotor disc 15 and blades 16 which together form the rotor of the turbine 13.

Each of the blades 16 comprises a root section 17 which engages with the disc 15 to support the blade, and an aerofoil 18 which reacts with the hot gas flow from the combustion section to provide the necessary rotation of the turbine rotor.

Because they operate in a very hot environment, each of the aerofoils 18 is provided with an air cooling system. A large variety of such systems are known, but in the present embodiment two air feed ducts 19 and 20 extend from the extremities of the root 17 into respective forward and rearward cavities 21 and 23 formed within the aerofoil 18. From the forward cavity 21 the air exhausts to the blade surface through a plurality of film cooling holes 23, while the air from the rearward cavity 22 exhausts through trailing edge apertures 24.

The positioning of the apertures 24 at the trailing edge is generally regarded as an optimum, because at this position the minimum aerodynamic disturbance is caused, and by passing the air through ducts or cavities at the trailing edge, additional cooling is provided for this exposed region of the blade.

However, it is mechanically difficult to make holes or cavities in this part of the aerofoil, because the trailing edge is thin for aerodynamic reasons and the ducts have to be accurately positioned and of very high aspect ratio. The present invention provides a way in which these ducts or cavities are produced without having to drill them or having to support the very thin cores required if the ducts or cavities are cast into the blade.

Thus, it will be seen from FIG. 3 that the aerofoil portion 18 of the blade is mainly formed by a single unitary cast structure which includes the forward skin or nose portion 25 surrounding the forward cavity 21, a partition 26 which divides the forward cavity 21 from the rearward cavity 22, and two rearward skin portions or side walls 27 which surround the rearward cavity 22. At its trailing extremities, the cast aerofoil is not complete. Thus although the convex flank 28 of the trailing edge itself is present and forms an integral extension of the convex side wall 27, the other concave flank is missing. The outer surface of this flank 28, which is formed as a continuation of the aerofoil surface or convex side wall 27, has the inner surface thereof, in this instance, provided with cast projections or pedestals 29. In the case illustrated these projections 29 are laid out in three rows extending parallel with the trailing edge.

Attached to the projections 29 and to the extreme portion of the concave flank part of the skin 27 there is a separately cast concave trailing edge flank piece 30. As can be seen from FIG. 2 this piece extends over the complete longitudinal extent of the trailing edge of the aerofoil 18, and as shown in FIG. 3 the external shape of the piece is such as to complete the trailing edge form of the aerofoil 18. In the present case, the flank 30 is cast precisely to shape, but it will be understood that if necessary the aerofoil may be machined after assembly of the flank 30 to the remainder of the blade and, particularly to the concave side wall 27, so as to finish the aerofoil shape and remove witness of whichever joining method is used between the flank 30 and the rest of the aerofoil.

Various joining methods may be used to retain the flank 30 to the projections 29 and the skin 27; thus a variety of welding or bonding methods could be used but in the present instance use of a brazing technique to form the joint at the joint face is envisaged.

It will be seen that the positioning of the flank 30 on the projections 29 leaves the necessary gap 24 at the trailing edge and it will be appreciated that it will be relatively easy to make the projections very shallow and therefore the gap 24 very narrow. Also the length of the gap between the cavity 22 and the trailing edge may be as long as is desired without any problems of drilling or casting high aspect ratio holes. Effectively, the joint face between the flank 30 and the flank 28 is cut away to leave the projections 29.

FIG. 4 shows how the gap 24 appears using the projections and flat interior surface of flank 30 described above, but clearly other forms of co-operating surfaces could be used. FIG. 5, for instance, shows the form of edge produced if two surfaces having cooperating channels 31 and 32 form the joint face; the effect is then of circular section passages. Other forms could obviously be achieved; in particular the flank 30 could have all the cooling channels etc formed on its inner surface while the inside of the trailing edge of the flank 28 could be relatively smooth.

In the above embodiment it has been assumed that, apart from possibly machining the aerofoil shape, the various pieces are cast to shape. However, it may be convenient in some cases to machine the cast pieces. In FIG. 6 there is shown a view similar to FIG. 3 but of a modified version. In this case the pedestals or projections on the inner surface of the convex flank of the trailing edge of the blade are not formed in the cast version. Instead, a solid blank piece 33 is cast in this location; the joint face of this blank is then chemically machined away to the shape indicated in dotted lines at 34 which will be seen to approximate to that of the projections 29.

Because of the high centrifugal loads on the various blade portions it may be desirable to provide mechanical location for the separate trailing edge piece, and FIG. 7 shows how this could be done. In this embodiment the separately cast trailing edge flank 40 is part of a complete separate longitudinal element of the blade, the element including additionally a platform piece 41, a shank piece 42 and a root piece 43. The root piece is a portion of the firtree which engages into a correspondingly shaped groove in the rotor disc, and it provides mechanical location for the entire element against centrifugal loads. The element is also metallurgically attached to the remainder of the blade as referred to in relation to the flank 30.

It will be noted that the construction of the invention, in addition to allowing the ducts or apertures for cooling air to be conveniently formed, allows the casting core which forms the rearward cavity in the aerofoil to be well supported.

It should also be understood that although described with reference to a rotor blade, the invention would also be applicable to stator vanes such as nozzle guide vanes and the like.

I claim:

1. An aerofoil blade or vane for a gas turbine engine comprising:

a hollow aerofoil portion fabricated from two separately cast elements and having an interior cooling passage for receiving a supply of cooling fluid, said aerofoil portion having an exit passage of minimum thickness along its trailing edge communicating with said interior passage for discharge of the cooling fluid therefrom;

one of said separately cast elements including a nose portion, spaced convex and concave side walls extending from said nose portion, and a flank extending from one of said side walls and forming a portion of the trailing edge;

a joint face formed by said flank and by a rear edge of the other of said walls;

said other of said cast elements forming a second flank for the other of said side walls when attached to said one of said cast elements at said joint face, said second flank being a minor portion of the other of said side walls and forming another portion of said trailing edge and being separated from said first flank to define said exit passage for the cooling fluid along the trailing edge; and means metallurgically attaching the other of said cast elements to said first cast element to form the aerofoil portion of the blade or vane with said exit passage of the trailing edge being of minimum thickness.

2. An aerofoil blade or vane as claimed in claim 1 comprising a plurality of channels provided in at least one of said flanks, said channels cooperating with the other of said flanks to form said exit passage.

3. An aerofoil blade or vane as claimed in claim 1 comprising channels provided in both of said flanks, said channels in one of said flanks cooperating with said channels in the other of said flanks to form said exit passage.

4. An aerofoil blade or vane as claimed in claim 1 in which one of said flanks includes projections extending therefrom and supporting the other of said flanks to provide a predetermined distance therebetween thereby defining said exit passage.

5. An aerofoil blade or vane as claimed in claim 1 and in which said blade or vane has a root portion by which it is supported from adjacent structure, said separately formed piece extending into said root portion to engage with the adjacent structure and provide mechanical support for the piece.

* * * * *